United States Patent [19]

Frenzl

[11] Patent Number: 4,564,190

[45] Date of Patent: Jan. 14, 1986

[54] APPLIANCE FOR PRACTICING AQUATIC SPORTS

[76] Inventor: Otto Frenzl, Lanserstrasse 56, A-6080 Innsbruck, Austria

[21] Appl. No.: 497,205

[22] Filed: May 23, 1983

[30] Foreign Application Priority Data

Jun. 7, 1982 [AT] Austria ..... 2191/82

[51] Int. Cl.[4] ..... A63G 21/18

[52] U.S. Cl. ..... 272/17; 272/1 B; 272/56.5 SS; 434/253; 406/93

[58] Field of Search ..... 272/56.5 R, 56.5 SS, 272/16, 17, 26, 1 B, 71, 72, 18, 32, 72; 137/563, 569, 565, 599, 566, 567; 405/81, 83, 77, 82; 406/105, 106, 93, 94, 95, 98; 104/69, 70, 71, 72, 73, 74

[56] References Cited

U.S. PATENT DOCUMENTS

| | | | |
|---|---|---|---|
| 3,038,760 | 6/1962 | Crooke | 406/105 |
| 3,216,455 | 11/1965 | Cornell et al. | 137/563 X |
| 3,565,491 | 2/1971 | Frazier | 406/93 X |
| 3,598,402 | 8/1971 | Frenzyl | 272/17 |
| 3,913,332 | 10/1975 | Forsman | 272/26 X |
| 4,197,815 | 4/1980 | Brazelton | 272/26 X |

FOREIGN PATENT DOCUMENTS

| | | | |
|---|---|---|---|
| 563489 | 9/1958 | Canada | 406/93 |
| 1118083 | 6/1968 | United Kingdom | 272/17 |
| 682238 | 8/1979 | U.S.S.R. | 272/32 |

*Primary Examiner*—Robert A. Hafer
*Assistant Examiner*—Arnold W. Kramer
*Attorney, Agent, or Firm*—Pahl, Lorusso & Loud

[57] ABSTRACT

In appliances for practicing aquatic sports with water flowing upwardly over a sloping bottom surface a premature breakdown of the flow caused by the accumulation of portions of water slowed down by friction at the boundary faces is prevented by at least partially removing said portions of slowed down water. This can be done by sucking off at least the increasingly portions of slowed down water which are preferably refed to a return pipe of the appliance. A further possibility provides that portions of slowed down water are accelerated by supplying water at an increased flow rate. Suction of the portions of slowed down water as well as the supply of water at an increased flow rate is particularly effected through apertures in the bottom surface in the regions in which the portions of water are particularly slowed down, i.e. above all in the regions in the vicinity of an overflow at the upper end of the sloping bottom surface.

6 Claims, 8 Drawing Figures the water layer 3 over the sloping bottom surface 1 increases from the bottom to the top towards the portion 7 at the side of the overflow because the flow rate V decreases with increasing height. The major part of the kinetic energy is transformed into potential energy. Hence, for obtaining circulation the power required for compensating the losses of flow is reduced and supplied by one or several water screws 6.

The major part of said losses is caused by friction occuring between the torrential flow of water 3 and the bottom surface 1. In FIG. 2, which shows portion I of FIG. 1, 3' indicates a portion of water slowed down by friction, and 3 indicates the major part of water shooting up at an unimpaired velocity V. In the water portion 3' the velocity increases from zero at the bottom surface 1 to V at the border to the layer of water 3 with unimpaired velocity.

Because of the low velocity of the water portion 3' said portion tends to flow downwardly along the bottom surface 1. Its weight component $W_t$ and also the difference of the water forces exerted upon assumed boundary faces $f_2$ and $f_1$ vertically extending to the bottom act in the downward direction. To simplify matters, it is supposed that the actual frictional force between the bottom surface 1 and water portion 3' which has already been slowed down moves towards zero as deceleration increases and is approximately $f_2=f_1=f$. Hence the downwardly acting force F' corresponds to the following formula: $F'=W_t+f\cdot\gamma\cdot(h_2-h_1)$, $h_2$ and $h_1$ being the depth of the whole water layer in points C and D, and $\gamma$ being the specific weight of the water. Therefore, force F' increasing with an increasing inclination of the bottom because of an increasing weight component $W_t$ of the water portion 3' and because of an increasing difference of the depths $h_2-h_1$ acts against the upwardly acting force F which continuously decreases as the velocity V of the major part of the water 3 decreases. Hence, a wedge-shaped increase of the slowed down water portion having the reference number 3'' occurs in the upper steepest part of the concave bottom surface 1. The thickness of the accumulated water portion 3'' increases excessively because of reflux and additionally increases the slope and the losses of the superjacent flow of the water 3. The torrential flow therefore breaks down at a certain height or certain angle of inclination, as can be seen at the right side of FIG. 2. FIG. 3 shows that this premature breakdown of the circulating flow will start in the vicinity of the side wall 4 in the rim region 8 as there is an increased slowed down portion of water 3'''. Furthermore, a water portion 3''' splashed against the wall by the person practicing the aquatic sport and then dropping there may have a further slowing down effect on the major part of the water 3. The flow could be maintained to a certain extent only by an increased power supply, which would result mainly in increased costs of operation.

FIG. 4 shows a view of a first embodiment of the invention of a portion I according to FIG. 2. According to the method of the invention at least the greatest portions of water 3'', 3''' strongly slowed down by friction are discharged or accelerated. The formation of water accumulations is obviated and, hence, the formation of a wedge-shaped downwardly moving portion of water 3'', i.e. opposite to the flow direction, is prevented. The portions of water 3'', 3''' are preferably sucked off through apertures 13 forming the mouths of discharge pipes 14 in the region 7 of the bottom surface 1 near the overflow or in the rim region 8. As schematically illustrated in FIG. 4, the portion of water 3' remaining after discharge of the portion of water 3'' is small so that the first-mentioned is not able to cause any appreciable disturbance to the flow.

The discharge or suction of water is easily possible in these regions without impairing use of the appliance because water is mainly discharged from those regions which are deeper anyway because of the decreased flow and because the discharged portion of water 3'' is small in respect of the portion of water 3 shooting up at the velocity V. The angle of inclination of the bottom surface 1 or its length and, hence, the obtainable height is thereby increased without requiring a substantial increase in the power supply. If the inclination of the bottom surface 1 is highly adjustable the suction capacity of the discharge pipe 14 is preferably adjustable, too. If the inclination of the bottom surface 1 is constant less driving power of the water screws 6 is required than in the state of the art in order to maintain circulation.

Additionally to the discharge of portions of slowed down water 3'', 3''', if desired also instead of the discharge, their acceleration is possible, too. In this case a similar effect occurs by feeding water at an increased flow rate through apertures 20 (FIGS. 6, 7) into the portions of slowed down water 3'', 3'''. In this manner too, a back-flowing wedge of water interrupting the flow can be prevented. A possible embodiment of the rim regions 8 between a side wall 4 and the bottom surface 1 is shown, for example, in FIGS. 5 to 7. In comparison with FIG. 3, friction can first be reduced by providing a round rim region 8, e.g. by fitting therein a rounded member 18. As illustrated in FIGS. 5 and 6, a number of apertures 13 are provided in the rounded member 18, the water being discharged, particularly sucked off, through said apertures. The rounded member 8 is interrupted upstream. This interruption is formed by an aperture 20 through which the water is fed from the feed pipe 19 at increased velocity. This accelerated water serves for accelerating the portion of water 3''' (FIG. 3) slowed down in the rim region 8, said portion of water being formed again after the discharge apertures 13, as well as for accelerating splashed portions of water 3'''', which may occur at times.

When the water 3 of the aquatic sports appliance is circulated it is preferably provided, as indicated in FIG. 8, that water 3'' discharged through the apertures 13 and discharge pipes 14 provided with valves 15 is refed into the return channel 5.

Alternatively, water portions discharged through a discharge pipe 14 can at other points, e.g. upstream, be refed via the fed pipe 19 at increased velocity to accelerate other water portions (FIG. 6). In this embodiment a common pipe 21 is provided between the apertures 13 and 20, pump means 17 being disposed in said pipe 21, for example the pump means of a filtering apparatus as frequently prescribed in appliances for practicing aquatic sports for the purification of the water.

The embodiment according to FIG. 8 has a further particular feature in comparison with the state of the art according to FIG. 1. The water reservoir 12' is of round or polygonal configuration, the inclined bottom surface 1' being substantially ring-shaped. It represents the surface area of a truncated cone or truncated pyramid, the generatrix being preferably concave. This embodiment does not only allow the practicing of aquatic sports within a circle, i.e. infinitely, but is also prevents altogether without discharge or acceleration the formation

APPLIANCE FOR PRACTICING AQUATIC SPORTS

FIELD AND BACKGROUND OF THE INVENTION

The invention relates to a method for preventing a premature breakdown of an upward flow of water caused by the accumulation of portions of water slowed down by friction at boundary faces of an appliance for practicing aquatic sports, the water being passed upwards over a sloping bottom surface, and further relates to an aquatic sports appliance comprising a water reservoir having a sloping bottom surface in which water is passed from a feed nozzle along the lower rim of said bottom surface upwardly to an overflow along the upper rim of said bottom surface.

DESCRIPTION OF THE PRIOR ART

U.S. Pat. No. 3,598,402 describes an aquatic sports appliance of this kind which is particularly suitable for practicing sliding sports, such as surf-riding, water-skiing etc.

The aquatic sports appliance comprises a vat in which the water is passed upwardly over a sloped bottom at a flow rate greater than a critical speed which is equal to the celerity of propagation in the flow of an infinitely small wave, whereby through the weight component of the user of the sliding sports device, which component is downwardly inclined and alterable by displacing the center of gravity, the oppositely directed flow resistance is at least partly compensated.

Hence, the various kinds of sports can also be practiced with one's hand free for some time. The water is preferably circulated from a lower feed nozzle over the shaping bottom surface upwardly with torrential flow and back to the lower feed nozzle via an overflow provided along the upper rim and a return channel, It is an essential feature that the great kinetic energy of the water when it exits from the feed nozzle, is largely transformed into potential energy, when the water shoots upwards, and said energy can be reutilized because of the closed return channel. Only reduced power is therefore required for recirculating the water as it must only compensate losses of flow.

More advanced devotees of such sports will desire an increased angle of inclination of the bottom surface. The latter-mentioned is, therefore, preferably adjustable, such adjustment being limited, however, by the friction at the boundary surfaces (bottom- and side faces) which effect slowing down of the layers or portions of water in the vicinity of the walls.

Particularly with concave bottom surfaces and in the border regions towards the side faces substantially wedge-shaped accumulations of slowed down water are formed, when there is a great angle of inclination, and these portions of water tend to flow downwards because of their weight. The wedge formation further increases the angle of inclination, hence the portion of upwardly shooting water suffers a further loss of flow, and the portion of slowed down water increases again. These processes cumulate in a breakdown of the torrential flow which can only be encountered by an increased power supply.

SUMMARY OF THE INVENTION

It is, therefore, the object of the invention to improve the degree of utilizing the power supplied to such appliances for practicing aquatic sports. This means that with unchanged power supply a rise of the obtainable water level, particularly an increase of the maximum angle of inclination, should be possible and that, if desired, only a reduced power supply should be necessary, when the level remains unchanged or the angle of inclination is at its maximum.

According to the invention this problem is solved by removing from the region of the upward flow at least those portions of water which are slowed down by friction at boundary faces to an increased extent. Removal of the portions of slowed down water can be effected by suction through the bottom surface, by acceleration thereof by supplying water at an increased flow rate, or by both measures, when a part of the portions of slowed down water being discharged, is accelerated by pump means, for example, and refed to other portions of slowed down water.

A preferred aquatic sports appliance for implementing the method, comprising a water reservoir having a sloping bottom surface in which water is passed from a feed nozzle along the lower rim of the bottom surface upwardly to an overflow along the upper rim of the bottom surface is characterized in that the water reservoir has apertures at least in the regions of each boundary surface in which the upwardly flowing water portions are increasingly slowed down by friction, said apertures forming the mouths of discharge pipes for the discharge of slowed down water portions or of feed pipes for feeding water at an increased flow rate for accelerating slowed down water portions.

DESCRIPTION OF THE DRAWINGS

In the following the invention will be described in more detail by means of the figures of the accompanying drawings.

In said drawings

Figure 1:
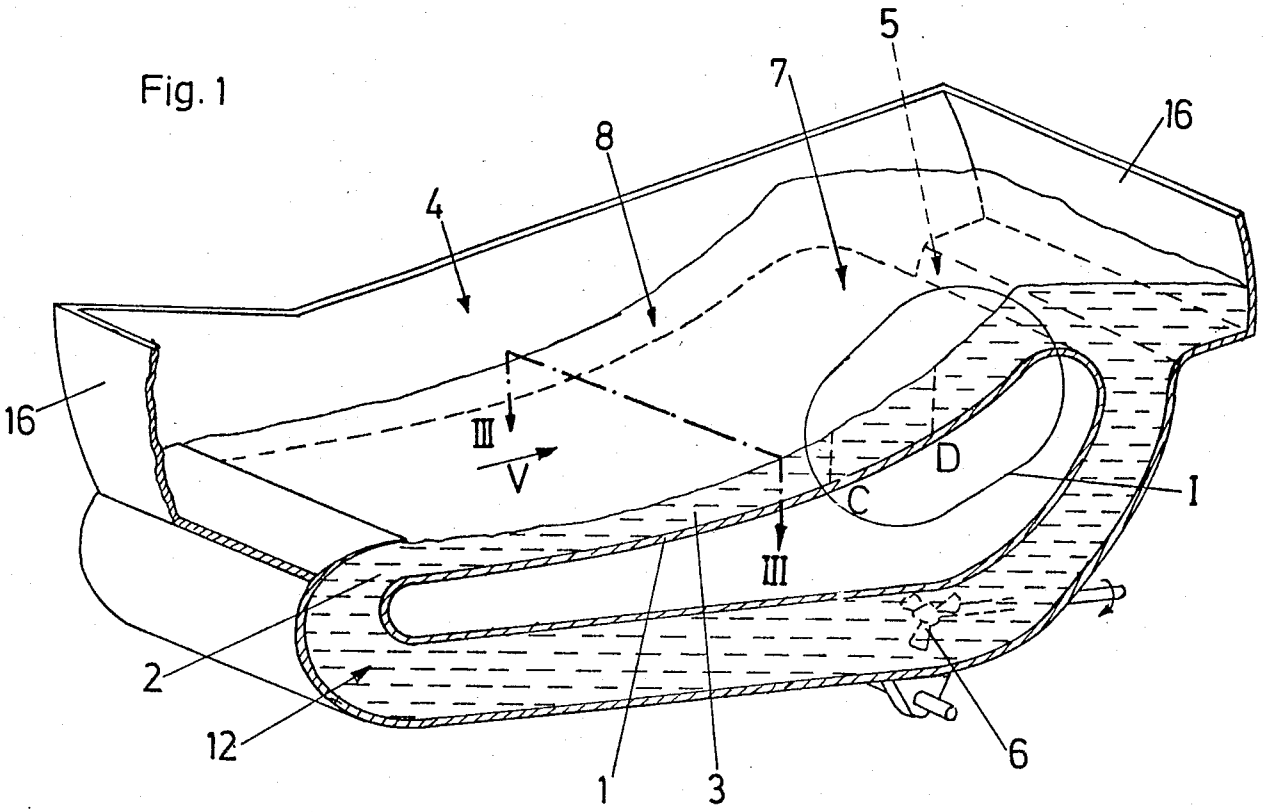
FIGS. 1 to 3 show an appliance for practicing aquatic sports according to the state of the art, FIG. 1 being a vertical sectional view of the appliance, FIG. 2 an enlarged view of a portion I of FIG. 1, and FIG. 3 a section along line III—III of FIG. 1.
Figure 2:
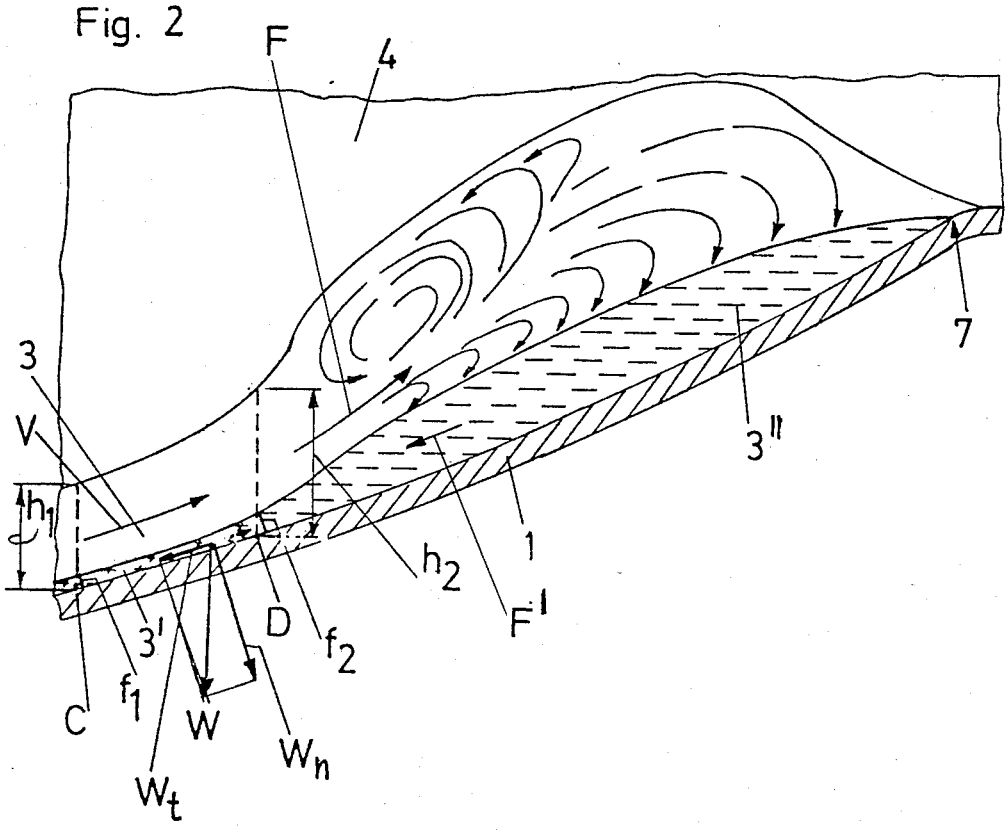
Figure 3:
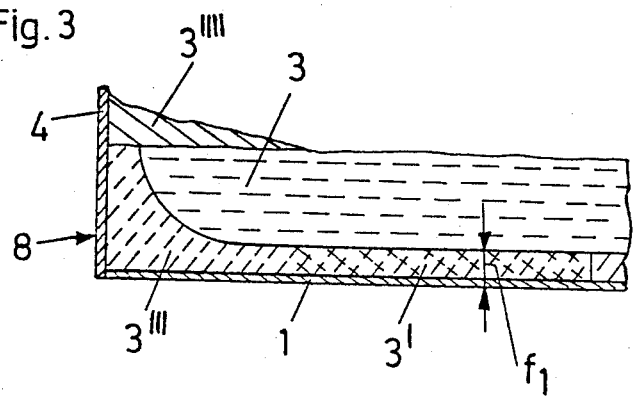
Figure 4:
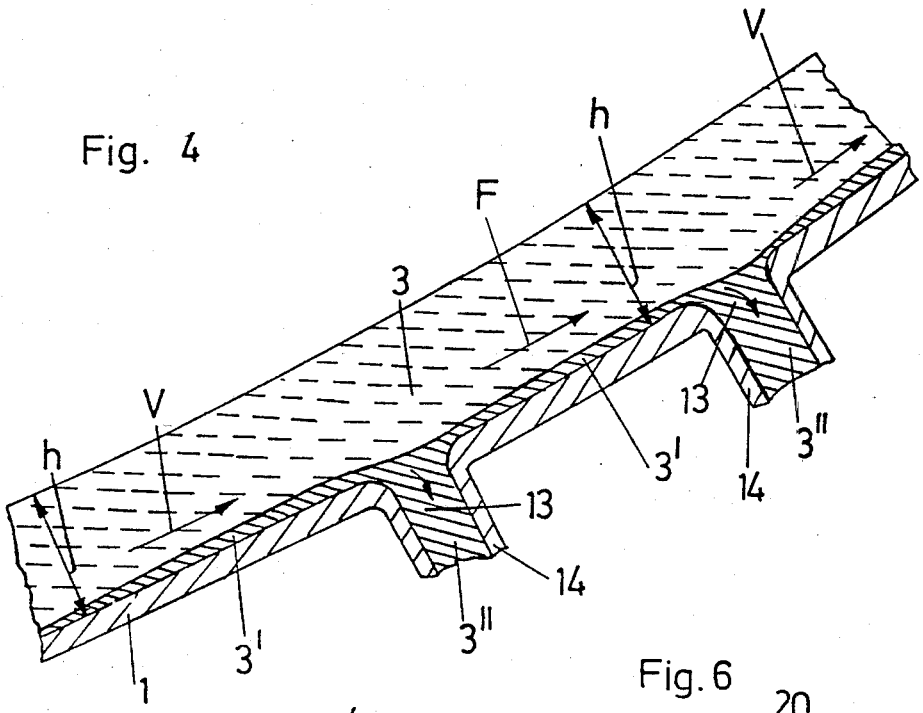
FIGS. 4 and 5 show a first embodiment according to the invention corresponding to portion I of FIG. 1 and to the section along line III—III, FIG. 5 also being a section along line V—V of FIG. 6.
Figure 5:
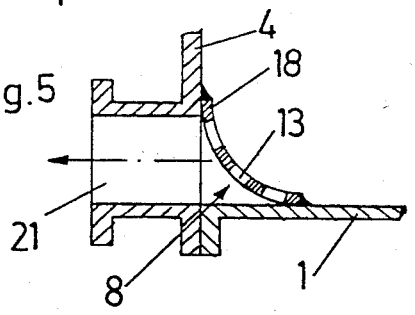
Figure 6:
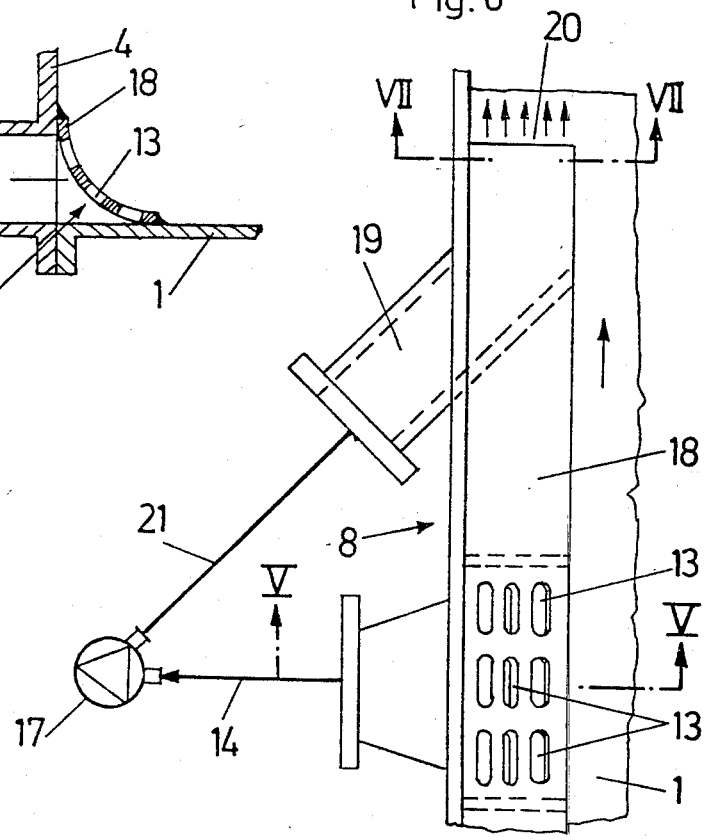
FIG. 6 shows a top view of a side wall region of said first embodiment.
Figure 7:
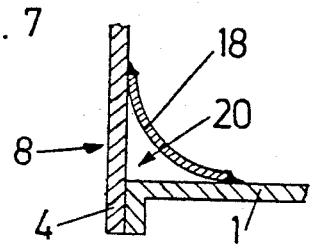
FIG. 7 shows a section along line VII—VII of FIG. 6.

An appliance according to the state of the art for practicing aquatic sports is shown in FIGS. 1—3. An inclined upwardly extending, particularly concave, bottom surface 1 is arranged in a water reservoir 12 and delimited by two side walls 4 and an upper and lower wall 16. An often multipart nozzle 2 extends along the lower rim of the bottom surface 1 through which water 3 is fed upwardly with a torrential flow parallel to the side walls 4. The water 3 flows via the region 7 of the bottom surface 1 at the side of the overflow and a return channel 5 back again to the nozzle 2. The thickness of of portions of water 3''', 3'''' because the bottom surface is not delimited by side walls 4 extending parallel to the flow direction. Because of the lack of a rim region 8 the inclination of the bottom surface 1 can be greater than in a water reservoir according to FIG. 1 delimited by side walls 4, the required power remaining the same.

Figure 8:
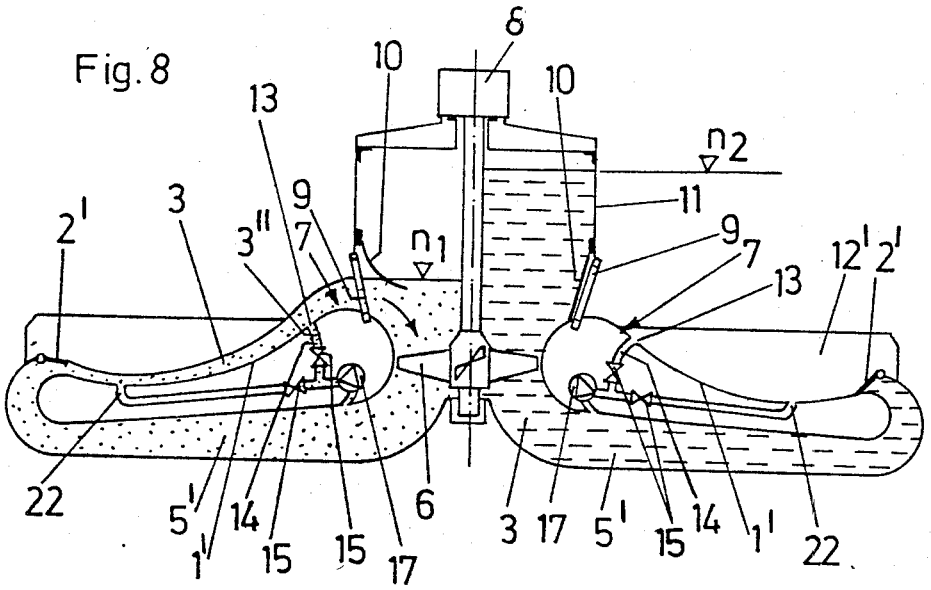
FIG. 8 shows a sectional view of second embodiment without side walls, the right half showing the inoperative or starting position and the left half the operative position.

In the embodiment according to FIG. 8 a high-level reservoir 11 serving for starting the flow is provided (right hald of FIG. 8). The peripheral nozzle 2' is closed, the high-level reservoir is filled up to the level $n_2$, and the return channel 5' is filled with water 3. The latter-mentioned was previously sucked through the bottom apertures 22 by the pump means 17 and fed into the high-level reservoir 11. In the region 7 at the side of the overflow, which is secured by a grate 9, a foil or flap 10 is disposed at the rear side of the grate 9, thus making the high-level reservoir 11 substantially tight. When the water screw 6 is in operation the nozzle 2' is rapidly opened so that the water shoots upwardly. The foils 10 clear the passage to the grate 9 because the total pressure of the water which initially shoots upwardly substantially corresponds to the level $n_2$, but the water level in the high-level reservoir 11 has in the meantime dropped almost to the level $n_1$. The portions of water 3'' slowed down by friction are then partly sucked off through the aperture 13, which form for example an annular gap, and fed into the return channel 5' via the pipes 14 which are now open.

The analogue is true for an appliance for practicing aquatic sports having a substantially circular ground plan and in which the water does not, as illustrated in FIG. 8, shoot upwardly from the externally positioned nozzle 2' radially into the interior but from a centrally arranged ringlike nozzle radially to the exterior.

If the appliance for practicing aquatic sports uses as a power source directly the height of fall of a river and, hence, has no water screws 6 and no water filtering pump the pump means 17 can be a water jet pump or can be replaced by a still simpler barometric fall-pipe.

In all cases the number of apparatuses required for realizing the invention is preferably small as the pumping means is either the one used in the obligatory purification of water or characterized by great simplicity.

What is claimed is:

1. An appliance for practicing aquatic sports using gliding devices supported atop a turbulent, non-separated flow of water, comprising:

a. an open water reservoir having a sloping bottom surface, surrounded by substantially vertical side walls, water being passed from a feed nozzle along the lower rim of said bottom surface upwardly to an overflow along the upper rim of said bottom surface;

b. apertures through the bottom surface and side walls of said reservoir at least in the regions of each boundary layer in which the upwards flowing portions of water are increasingly slowed down by friction, said apertures forming the mouths of discharge pipes for the discharge of portions of slowed down water;

c. additional apertures through the bottom surface and side walls of said reservoir at least in the regions of each boundary layer in which the upwards flowing portions of water are slowed down by friction, said additional apertures forming the mouths of feed pipes for feeding water at an increased flow rate substantially tangential to the direction of flow of said turbulent flow of water for accelerating portions of slowed down water;

d. means for connecting each of said apertures with a respective one of said additional apertures such that said apertures and said respective additional apertures form the mouths of a common pipe; and e. means associated with said common pipe discharging portions of slowed down water through the first of said apertures and refeeding them at an increased flow through said respective additional apertures to other portions of slowed down water.

2. An appliance for practicing aquatic sports as claimed in claim 1, wherein said means discharging and refeeding at an increased flow are driven pump means.

3. An appliance for practicing aquatic sports as claimed in claim 1, wherein said means discharging and refeeding at an increased flow also serve for discharging water standing on said bottom surface prior to the start of flow.

4. An appliance for practicing aquatic sports as claimed in claim 1, wherein said means discharging and refeeding at an increased flow is a circulating pump serving for the transport of water through an apparatus purifying the water.

5. An appliance for practicing aquatic sports as claimed in claim 1 in which the water is fed upwardly over said sloping bottom surface and refed to said feed nozzle below said bottom surface through a return channel, wherein the discharge pipes discharging portions of slowed down water extend into said return channel and have means for increasing the flow rate of the water flowing through.

6. An appliance for practicing aquatic sports as claimed in claim 5, wherein said means is a circulating pump serving for the transport of water through an apparatus purifying the water.

* * * * *